US008303776B2

(12) United States Patent
Lahdensuo

(10) Patent No.: US 8,303,776 B2
(45) Date of Patent: Nov. 6, 2012

(54) SHOE PRESS BELT

(75) Inventor: Ville Lahdensuo, Kangasala (FI)

(73) Assignee: Tamfelt PMC Oy, Tampere (FI)

( * ) Notice: Subject to any disclaimer, the term of this patent is extended or adjusted under 35 U.S.C. 154(b) by 419 days.

(21) Appl. No.: 12/596,799

(22) PCT Filed: Jul. 3, 2008

(86) PCT No.: PCT/FI2008/050408

§ 371 (c)(1),
(2), (4) Date: Oct. 20, 2009

(87) PCT Pub. No.: WO2009/004122

PCT Pub. Date: Jan. 8, 2009

(65) Prior Publication Data

US 2010/0130701 A1 May 27, 2010

(30) Foreign Application Priority Data

Jul. 5, 2007 (FI) ..... 20075517

(51) Int. Cl.
*D21F 3/02* (2006.01)
*B32B 27/20* (2006.01)
*B32B 27/40* (2006.01)

(52) U.S. Cl. ..... 162/358.4; 162/901; 442/70; 442/74; 442/148

(58) Field of Classification Search ..... 162/358.3, 162/358.4, 901; 442/70, 72–75, 101, 104, 442/79, 80, 148, 170, 218, 220; 427/389.9, 427/394, 397.7; 428/167
See application file for complete search history.

(56) References Cited

U.S. PATENT DOCUMENTS

| | | | | |
|---|---|---|---|---|
| 2002/0060052 | A1 | 5/2002 | Best | |
| 2005/0203248 | A1 | 9/2005 | Zheng et al. | |
| 2005/0208288 | A1 * | 9/2005 | Li et al. | 428/304.4 |
| 2006/0204657 | A1 | 9/2006 | Baker et al. | |
| 2007/0077388 | A1 | 4/2007 | Westerkamp et al. | |
| 2007/0259994 | A1 * | 11/2007 | Tour et al. | 523/333 |

FOREIGN PATENT DOCUMENTS

| | | | | |
|---|---|---|---|---|
| EP | 0 534 041 | A1 | | 3/1993 |
| EP | 1 338 696 | A1 | | 8/2003 |
| FI | 2005-5556 | | | 10/2005 |
| JP | 2003-322218 | | * | 11/2003 |
| WO | WO 2005/014708 | A1 | | 2/2005 |
| WO | WO 2005/082988 | | * | 9/2005 |
| WO | WO 2005/082993 | A1 | | 9/2005 |
| WO | WO 2005/090429 | A1 | | 9/2005 |
| WO | WO 2006/040398 | A1 | | 4/2006 |
| WO | WO 2008/104224 | | * | 9/2008 |
| WO | WO 2009/004122 | A1 | | 1/2009 |

* cited by examiner

*Primary Examiner* — Eric Hug
(74) *Attorney, Agent, or Firm* — Oliff & Berridge, PLC

(57) ABSTRACT

The invention relates to a shoe press belt comprising an elastomer polymer having nanoparticles attached therewith through covalent bonds.

10 Claims, No Drawings

SHOE PRESS BELT

BACKGROUND OF THE INVENTION

The invention generally relates to belts used in different phases of a papermaking process. More particularly, the invention relates to shoe press belts used in shoe presses of press sections in board, paper and pulp machines, as well as in shoe presses of a paper machine calender when manufacturing certain types of paper.

Shoe presses are generally used in pulp, cardboard and paper machines for dewatering a fibre web. One surface of a wet fibre web travelling at a high speed in such shoe presses is pressed by a press roll while simultaneously the other surface of the fibre web is pressed by a pressure shoe surrounded by an endless belt with an elastic elastomer body. One such press belt is described in Finnish Patent Application No. 20055556.

In general, a shoe press belt is subjected to recurrent strong flexing and pressing forces between a press roll and a pressure shoe as the fibre web passes at a high speed through the shoe presses. During use, these stresses may cause the belt material to crack over time and, eventually, the belt is damaged beyond usability. A general trend has been to increase both the web speed and the pressing pressure in paper machines. Thus, the belts of the shoe presses used therein are also subjected to larger and larger loads, so the belts are required to possess a plurality of various properties in order to ensure high performance. As the speeds of paper machines increase, a high thermal conductivity of a belt plays an essential role as far as the operating life of the belt is concerned. A high thermal conductivity allows heat to be conducted to the surrounding water and oil, which diminishes the problems caused by excessive heat on the belt, thus extending the operating life of the belt.

EP 1338696 A1 describes a belt suitable for papermaking, comprising a reinforcing substrate embedded in a polyurethane layer. The outer peripheral surface of the belt, which is in direct contact with a supporting press felt of the fibre web, is formed from polyurethane made from a urethane prepolymer and dimethylthiotoluenediamine (DMTDA) as a hardener. The belt aims at decreasing cracking, which generally occurs on outer surfaces of the belts in particular, as well as at preventing delamination between the hardener and the polyurethane layer.

WO 2005/090429 discloses a belt which is coated with polyurethane and which comprises nanoparticles. Such a belt aims at improving e.g. its resistance to flex fatigue and crack propagation as well as at providing hardness and wear characteristics. The nanoparticles are dispersed either in a hardener or in a urethane prepolymer prior to mixing the hardener and the prepolymer so as to obtain a polyurethane. Irrespective of the manner of adding the nanoparticles, a coating contains nanoparticles in a dispersed form. The dispersion of the nanoparticles provides the polyurethane belt with abrasion resistance but, irrevocably, simultaneously impairs the elasticity characteristic of polyurethane. Such impaired elasticity means that the belt becomes more inclined to cracking.

WO 2006/040398 describes hybride nanomaterials which are produced by attaching nanoparticles with different chemical groups. Such attachment is carried out by cutting the nanoparticles by means of ultrasound, whereby highly reactive broken bonds created during the cutting react with the different chemical groups that are present. The nanoparticles consist of substances containing carbon, such as carbon nanotubes. The chemical groups may be inorganic, organic, polymeric and biological molecules and particles. The nanoparticles are capable of bonding with the chemical groups through covalent and non-covalent bonds. The obtained hybrid materials are reported to exhibit a good tensile strength and a high electrical and thermal conductivity, and they are considered suitable for many different uses, such as paper machine rolls and support structures.

It is thus desirable to provide a shoe press belt which is thermally highly conductive and highly resistant to cracking, or, should cracking occur, crack propagation is decelerated substantially.

BRIEF DESCRIPTION OF THE INVENTION

An object of the invention is thus to provide a shoe press belt so as to enable the aforementioned problems to be alleviated. The object of the invention is achieved by a shoe press belt which is characterized by what is set forth in the independent claims. Preferred embodiments of the invention are disclosed in the dependent claims.

An advantage of a shoe press belt according to the invention is that owing to the nanoparticles contained therein, the shoe press belt is thermally highly conductive and, at the same time, owing to its network-like elastomer structure, it is elastic and tensile, which makes the belt highly resistant to cracking.

DETAILED DESCRIPTION OF THE INVENTION

The invention provides a novel shoe press belt which is characterized in that it contains an elastomer polymer having nanoparticles attached therewith through a covalent bond.

The elastomer material used in the manufacture of the shoe press according to the invention may be any elastomer material generally used for manufacturing belts used in papermaking, such as polyurethane and elastic epoxy. A common feature shared by elastomers is that they are elastic, ductile and capable of recovering their original shape when a force causing a tensile strain is removed. Preferably, the invention utilizes a polyurethane elastomer. In the following, the invention will be described in greater detail in the light of this preferred embodiment, although it is to be appreciated that any elastomer material may be used in the shoe press belt according to the invention.

The invention employs a technology known per se for manufacturing a polyurethane usable as an elastomer, wherein a urethane prepolymer component, which has isocyanate groups (NCO) at its ends, is mixed with a chain extender component with hydroxyl (OH) or amine ($NH_2$) groups. As apparent from its name, the chain extender causes prepolymer chains to extend by combining long prepolymer chains. Typically, a chain extender is either a multifunctional alcohol, such as dial or trial, or multifunctional amine, such as diamine or triamine compound which reacts with the isocyanate groups contained in a reaction mixture, forming urethane or urea bonds. In the production of polyurethane used in the shoe press belt according to the invention, a quasi-prepolymer, a full prepolymer, or one shot method can be used. These methods are well known to those skilled in the art. In general, in the quasi-prepolymer method, the di-isocyanate is partially reacted with a polyol to form a quasi-prepolymer. There is still an excess of unreacted free di-isocyanate left after the prepolymerization. The remaining of the polyol is then added with the chain extender. In the full prepolymer method, the di-isocyanate is totally reacted with the polyol to form the prepolymer with less than 5%, preferably less than 0.1%, free di-isocyanate. It is also possible to use a "one shot" technique known per se, which comprises no prepolymerization phase between di-isocyanate and polyol but which comprises reacting the di-isocyanate, polyol and possibly also a chain extender simultaneously with one another.

In an embodiment of the invention, in accordance with the quasi-prepolymer method, the urethane prepolymer component, referred to as component A in the present invention, is formed from isocyanate and polyol such that the urethane prepolymer component comprises isocyanate-ended polyol as well as di-isocyanate that is still free. The content of free di-isocyanate in the component may be approximately 10 to 50% by weight. In addition to the actual chain extender, the other component B necessary for producing a urethane polymer, referred to as component B in the present invention, also comprises a polyol. The isocyanate groups in component A are reacted with the amine or hydroxyl groups of component B producing long polyurethane chains containing urea or urethane bonds. These chains can be crosslinked by biuret or allophanate bonds or by multifunctional chain extenders in order to achieve a cross-linked polymer structure, which enables an elastic structure typical of polymer to be formed. The mixing proportion A:B between the components A and B is e.g. 100:80.

The polyol to be used may be a polyether polyol, polyester polyol, polyether carbonate polyol or a polyester carbonate polyol. Polyether polyols include, without being restricted thereto, polytetramethylene ether glycol (PTMEG), polypropylene glycol (PPG), polyethylene glycol (PEG), polyhexamethylene ether glycol; polyester polyols include polyadipate of monoethyleneglycol, and polycaprolactone; polyethercarbonates include —O—COO—[$C_nH_{2n}$—O—$C_nH_{2n}$]—O—COO—, n=2 to 6, without, however, being restricted thereto. Preferably, PTMEG or polyethercarbonates are used.

As an isocyanate component, any di-isocyanate usable in the production of polyurethanes may be used. Such di-isocyanates include 4,4'-, 2,4'-, or 2,2'-diphenylmethane diisocyanate (MDI), a polymer of MDI (PMDI), 2,4- or 2,6-toluene diisocyanate (TDI), 1,5-naphthalene diisocyanate (NDI), bis-(4-isocyanate-cyclohexyl)-methane ($H_{12}$MDI), 1,6-hexanediisocyanate (HDI), isophoronide isocyanate (IPDI), 1,4-phenylenediisocyanate (PPDI), trans-1,4-cyclohexyldiisocyanate (CHDI). Preferably, MDI is used.

In another embodiment of the invention, in accordance with the full prepolymer method, the urethane prepolymer component A is formed from di-isocyanate and polyol such that all polyol to be used is in the component A and the amount of free di-isocyanate is approximately 0 to 1% by weight. Usable di-isocyanates and polyols have been disclosed above. In this embodiment, the other component B necessary for producing a urethane polymer is a chain extender, which can be a substance as previously defined.

Regardless of technique by which the polyurethane usable in the present invention is prepared, in said embodiments, multifunctional alcohol- or multifunctional amine-type compounds generally used in the production of polyurethanes are used as the chain extender, as already previously mentioned, and those knowledgeable in the art will recognize such compounds. In addition to these, higher functionality structures such as triols and triamines can be used. Examples of diol chain extenders, without, however, being restricted thereto, include 1,6-hexanediol, diethyleneglycol, 2-methyl-1,3-propanediol, 3-methyl-1-ethyleneglycol, 1,2-propyleneglycol, 1,3-propanediol, 1,4-butanediol, 5-pentanediol, 2,2-dimethyl-1,3-propanediol, 2,2,4-trimethyl-1,5-pentanediol, 2-methyl-2-ethyl-1,3-propanediol, 1,4-bis(hydroxyethoxy) benzene, bis(hydroxyethylene) terephtalate, hydroquinonebis(2-hydroxyethyl)ether, and combinations thereof. Useful triols are trimethylol propane and tri-isopropanolamine, for instance. In the present invention, a preferred chain extender of this type is 1,4-butanediol.

Examples of diamine-type chain extenders include, without being restricted thereto, 3,3'-dichloro-4,4'-diaminodiphenylmethane (MOCA or MBOCA), 4,4'-methylene-bis(3-chloro-2,6-diethylaniline) (MCDEA), dimethylthiotoluenediamine (DMTDA) such as "Ethacure 300" by Albemarle Corporation, diethyltoluenediamine (DETDA), and aminobenzoate such as "Polacure 740M" by Polaroid Corporation. Preferably, MOCA or DMTDA is used.

Nanoparticles are generally considered to refer to particles of 1 to 100 nm in size. Any particles of this order of magnitude may be used in the present invention. Materials usable in the shoe press belt according to the present invention include clay, carbon black, silicon dioxide, silicon carbide, and metal oxides such as aluminium oxide. Nanoparticles that are either of one or more different types may be added to the elastomer, and they may also vary in size. In the preferred embodiment of the invention, carbon nanotubes are used. The structure of carbon nanotubes, a network formed by carbon atoms hexagonally attached with one another through covalent bonds, is very similar to that of graphite. Carbon nanotubes can be considered to be formed by a long and narrow graphite plate that has been rolled into a tubular shape. These nanotubes are called single wall nanotubes (SWCNT). Carbon nanotubes may be also be multi wall nanotubes (MWCNT).

Nanoparticles are added to a starting material used for producing an elastomer in an amount to provide a final content of approximately 0.1 to 10% by weight, preferably 0.5 to 3% by weight, in the elastomer.

The attachment of the nanoparticles with the elastomer material is achieved by using ultrasound, whereby the extremely stable covalent bonds, the covalent carbon-carbon bonds of nano carbon tubes in particular, are broken, and the resulting highly reactive bonds are rapid in reacting, forming a covalent bond with the present reagents. Thus, by means of nanoparticles bound with the elastomer material through new chemical bonds, a completely novel modified network-like elastomer structure having the properties required of the shoe press belt according to the invention, i.e. high tensile strength and toughness, is achieved. The frequency of ultrasound applied to the reaction mixture is about 20 kHz to 1 MHz. The ultrasound treatment may be either continuous or intermittent.

It is apparent to one skilled in the art that the nanoparticles can be activated not only by ultrasound treatment but also in any other suitable manner, e.g. chemically, so as to make these particles attach with the elastomer material.

The nanoparticles may be introduced into the polyurethane material by mixing them with the production component B or a portion thereof. In the first alternative, if the component B only comprises a chain extender in accordance with the full prepolymer method, the nanoparticles are thus added to the chain extender. The thus obtained reaction mixture containing nanoparticles is then treated with ultrasound, resulting in the particles attaching with the chain extender. The obtained chain extender modified with nanoparticles is then used for producing polyurethane together with the production component A. If, in addition to the chain extender, the component B also comprises a polyol in accordance with the quasi-prepolymer method, the nanoparticles can be added to the polyol and/or chain extender. In an embodiment of the invention, the nanoparticles are added to the polyol. In another embodiment of the invention, the nanoparticles are added both to the polyol and the chain extender. The addition can happen either to each of the polyol and chain extender separately, or a mixture of said two materials. In the first alternative, the polyol and chain extender are treated by sonification separately whereafter they are combined to form the component B. In the latter alternative, the polyol and the chain extender are first combined together whereafter the resulting mixture is subjected to sonification to produce the component B.

Alternatively, the nanoparticles can be introduced into the production component A or a portion thereof. In an embodiment of the invention, the nanoparticles are added to the prepolymer and treated with sonification. In another embodiment of the invention, the nanoparticles are added to the polyol which is used to make a prepolymer. In still another embodiment of the invention, the nanoparticles are added to the di-isocyanate which is then used to make a prepolymer. If the nanoparticles are introduced to the component A, it is not any more necessary to introduce them in the component B, even though this is possible if a higher concentration of nanoparticles is preferred.

In the one-shot method, the nanoparticles can be introduced to one or both of the polyol and the chain extender.

In a preferred embodiment of the invention, the nanoparticles are added to the diamine chain extender, prior to adding the chain extender to the reaction mixture. In any embodiment of the invention, the total amount of the nanoparticles added to polyol and/or chain extender is about 1-50 weight %.

Without wishing to commit oneself to any theory, it is likely that the ultrasound treatment produces a reactive fusion of carbon nanotubes between the carbon chain of a polyol or multifunctional amine or isocyanate through a covalent carbon-carbon bond.

The obtained elastomer materials modified with nanoparticles are thermally highly conductive. In addition, owing to their network-like structure, they are strong and tough.

It is apparent to those skilled in the art that as technology advances, the basic idea of the invention may be implemented in many different ways. The invention and its embodiments are thus not restricted to the above-described examples but may vary within the scope of the claims.

The invention claimed is:

1. A shoe press belt comprising an elastomer polymer having nanoparticles attached therewith through covalent bonds, the covalent bonds being provided by subjecting a reaction mixture containing nanoparticles to ultrasound frequencies.

2. The shoe press belt as claimed in claim 1, wherein the elastomer polymer is polyurethane.

3. The shoe press belt as claimed in claim 1, wherein the reaction mixture containing nanoparticles further comprises a polyol.

4. The shoe press belt as claimed in claim 3, wherein a modified polyol obtained by ultrasound treatment is suitable for producing polyurethane.

5. The shoe press belt as claimed in claim 3, wherein a modified polyol obtained by ultrasound treatment, together with a chain extender, is suitable for producing polyurethane.

6. The shoe press belt as claimed in claim 1, wherein the reaction mixture containing nanoparticles comprises a multifunctional alcohol or amine suitable as a chain extender in a polyurethane reaction.

7. The shoe press belt as claimed in claim 6, wherein a modified chain extender obtained by ultrasound treatment is suitable for producing polyurethane.

8. The shoe press belt as claimed in claim 1, wherein a nanoparticle is 1 to 100 nm in size.

9. The shoe press belt as claimed in claim 8, wherein the nanoparticle is a nano carbon tube.

10. The shoe press belt as claimed in claim 1, wherein the amount of nanoparticles in the elastomer polymer is about 0.1 to 10% by weight.

* * * * *